US012345105B2

(12) United States Patent
McKenzie

(10) Patent No.: US 12,345,105 B2
(45) Date of Patent: Jul. 1, 2025

(54) HORIZONTAL RACKING AND STAND BUILDING SYSTEM

(71) Applicant: NATIONAL OILWELL VARCO, L.P., Houston, TX (US)

(72) Inventor: Andrew Ian McKenzie, Cypress, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/005,321

(22) PCT Filed: Jun. 29, 2021

(86) PCT No.: PCT/US2021/070786
§ 371 (c)(1),
(2) Date: Jan. 12, 2023

(87) PCT Pub. No.: WO2022/016168
PCT Pub. Date: Jan. 20, 2022

(65) Prior Publication Data

US 2023/0258046 A1 Aug. 17, 2023

Related U.S. Application Data

(60) Provisional application No. 63/052,150, filed on Jul. 15, 2020.

(51) Int. Cl.
*E21B 19/15* (2006.01)
*E21B 19/20* (2006.01)

(52) U.S. Cl.
CPC ..... *E21B 19/155* (2013.01); *E21B 19/20* (2013.01)

(58) Field of Classification Search
CPC ..... E21B 19/155; E21B 19/20
See application file for complete search history.

(56) References Cited

U.S. PATENT DOCUMENTS 1,818,278 A 8/1931 Siler
2,531,930 A 11/1950 Woolslayer et al.
(Continued)

FOREIGN PATENT DOCUMENTS

CA 2911388 A1 11/2014
CA 2855105 A1 12/2015
(Continued)

OTHER PUBLICATIONS

"U.S. Appl. No. 16/098,160, Examiner Interview Summary mailed Jun. 23, 2020", 3 pgs.
(Continued)

*Primary Examiner* — Lynn E Schwenning
(74) *Attorney, Agent, or Firm* — Schwegman Lundberg & Woessner, P.A.

(57) ABSTRACT

A horizontal pipe storing and stand building system may include a pipe rack and a horizontal stand building system arranged adjacent to the pipe rack and configured to receive tubulars from the pipe rack and construct pipe stands in a horizontal orientation. The system may also include a delivery system arranged adjacent the horizontal stand building system and opposite the pipe rack. The delivery system may be configured to receive horizontally arranged pipe stands from the horizontal stand building system and deliver them to a drill rig.

7 Claims, 15 Drawing Sheets

(56) References Cited

U.S. PATENT DOCUMENTS

| | | | | |
|---|---|---|---|---|
| 2,615,681 | A | 10/1952 | True | |
| 2,735,556 | A | 2/1956 | Stone | |
| 2,885,096 | A | 5/1959 | De | |
| 2,946,464 | A | 7/1960 | Guier | |
| 3,225,949 | A | 12/1965 | Erickson et al. | |
| 3,272,365 | A | 9/1966 | Stevens | |
| 3,533,516 | A | 10/1970 | Guier | |
| 3,615,027 | A | 10/1971 | Ham | |
| 3,655,071 | A * | 4/1972 | Langowski | E21B 19/155 414/22.58 |
| 3,768,663 | A | 10/1973 | Turner et al. | |
| 3,921,823 | A | 11/1975 | Bourree et al. | |
| 3,976,207 | A | 8/1976 | Schultz | |
| 3,994,350 | A | 11/1976 | Smith et al. | |
| 4,042,123 | A | 8/1977 | Sheldon et al. | |
| 4,117,941 | A | 10/1978 | Mccleskey, Jr. et al. | |
| 4,274,778 | A | 6/1981 | Putnam et al. | |
| 4,348,920 | A | 9/1982 | Boyadjieff | |
| 4,397,605 | A | 8/1983 | Cowgill et al. | |
| 4,531,875 | A | 7/1985 | Krueger | |
| 4,591,006 | A | 5/1986 | Hutchison et al. | |
| 4,621,974 | A | 11/1986 | Krueger | |
| 4,680,519 | A | 7/1987 | Chand et al. | |
| 4,715,761 | A | 12/1987 | Berry et al. | |
| 4,738,321 | A | 4/1988 | Olivier | |
| 5,038,871 | A | 8/1991 | Dinsdale | |
| 5,211,251 | A | 5/1993 | Woolslayer | |
| 5,813,286 | A | 9/1998 | Hansen | |
| 5,921,329 | A | 7/1999 | Armstrong | |
| 6,260,646 | B1 | 7/2001 | Fernandez et al. | |
| 6,412,576 | B1 | 7/2002 | Meiners | |
| 7,726,929 | B1 | 6/2010 | Orgeron | |
| 7,905,311 | B2 | 3/2011 | Brown | |
| 7,984,757 | B1 | 7/2011 | Keast et al. | |
| 7,992,646 | B2 | 8/2011 | Wright et al. | |
| 8,191,637 | B2 | 6/2012 | Havinga | |
| 8,215,887 | B2 | 7/2012 | Fikowski et al. | |
| 8,550,761 | B2 | 10/2013 | Belik et al. | |
| 9,291,010 | B1 | 3/2016 | Barnes | |
| 10,384,907 | B2 | 8/2019 | Upmeier et al. | |
| 10,422,192 | B2 | 9/2019 | Richardson et al. | |
| 2002/0079105 | A1* | 6/2002 | Bergeron | E21B 19/16 166/85.5 |
| 2003/0159854 | A1 | 8/2003 | Simpson et al. | |
| 2004/0057815 | A1 | 3/2004 | Woolslayer et al. | |
| 2005/0126792 | A1 | 6/2005 | Berry | |
| 2006/0081379 | A1 | 4/2006 | Fehres et al. | |
| 2006/0104747 | A1 | 5/2006 | Zahn et al. | |
| 2006/0124316 | A1 | 6/2006 | Pietras | |
| 2006/0231344 | A1 | 10/2006 | Drzewiecki | |
| 2006/0249292 | A1 | 11/2006 | Guidry | |
| 2007/0062705 | A1 | 3/2007 | Schats et al. | |
| 2008/0238095 | A1 | 10/2008 | Yater et al. | |
| 2008/0296065 | A1 | 12/2008 | Standal | |
| 2009/0283324 | A1 | 11/2009 | Konduc et al. | |
| 2010/0163247 | A1* | 7/2010 | Wright | E21B 19/155 166/380 |
| 2010/0193198 | A1 | 8/2010 | Murray et al. | |
| 2010/0303586 | A1 | 12/2010 | Hankins et al. | |
| 2011/0030942 | A1* | 2/2011 | Orgeron | F16L 1/19 166/77.51 |
| 2011/0079434 | A1 | 4/2011 | Belik et al. | |
| 2011/0226485 | A1 | 9/2011 | Seneviratne et al. | |
| 2012/0018222 | A1 | 1/2012 | Hankins et al. | |
| 2013/0075114 | A1 | 3/2013 | Dekker et al. | |
| 2013/0142607 | A1 | 6/2013 | Ditzler | |
| 2014/0054089 | A1 | 2/2014 | Sondervik | |
| 2014/0097027 | A1 | 4/2014 | Marica et al. | |
| 2014/0145408 | A1 | 5/2014 | Midas et al. | |
| 2015/0053424 | A1 | 2/2015 | Wiens et al. | |
| 2015/0232272 | A1 | 8/2015 | Magnuson | |
| 2015/0275596 | A1 | 10/2015 | Hickie | |
| 2016/0060979 | A1 | 3/2016 | Magnuson | |
| 2016/0115745 | A1 | 4/2016 | Bisel | |
| 2016/0145954 | A1 | 5/2016 | Helms et al. | |
| 2016/0160586 | A1 | 6/2016 | Keogh et al. | |
| 2017/0172295 | A1 | 6/2017 | Tropper | |
| 2017/0204687 | A1* | 7/2017 | Yorga | E21B 19/161 |
| 2017/0234088 | A1 | 8/2017 | Orr et al. | |
| 2017/0306710 | A1 | 10/2017 | Trydal et al. | |
| 2018/0328125 | A1* | 11/2018 | Folk | E21B 19/16 |
| 2018/0334865 | A1 | 11/2018 | Miller et al. | |
| 2019/0017334 | A1* | 1/2019 | Loeyning | E21B 19/16 |
| 2019/0145197 | A1 | 5/2019 | Callaghan | |
| 2019/0309585 | A1 | 10/2019 | Miller et al. | |
| 2019/0352982 | A1* | 11/2019 | Arefi | E21B 19/155 |
| 2020/0040673 | A1 | 2/2020 | Donnally et al. | |
| 2020/0040674 | A1 | 2/2020 | Mckenzie et al. | |
| 2022/0003054 | A1 | 1/2022 | Mikalsen et al. | |
| 2022/0226990 | A1 | 7/2022 | Wu et al. | |

FOREIGN PATENT DOCUMENTS

| | | | |
|---|---|---|---|
| CN | 108266139 | A | 7/2018 |
| CN | 110792399 | A | 2/2020 |
| CN | 114278238 | | 4/2022 |
| EP | 1953334 | A2 | 8/2008 |
| GB | 2091788 | A | 8/1982 |
| GB | 2532267 | A | 5/2016 |
| NO | 20151648 | A1 | 12/2015 |
| WO | WO-8800274 | A2 | 1/1988 |
| WO | WO-9958811 | A1 | 11/1999 |
| WO | WO-0123701 | A1 | 4/2001 |
| WO | WO-2004018829 | A1 | 3/2004 |
| WO | WO-2013082172 | A1 | 6/2013 |
| WO | WO-2014179730 | A1 | 11/2014 |
| WO | WO-2016024859 | A1 | 2/2016 |
| WO | WO-2016197255 | A1 | 12/2016 |
| WO | WO-2017039996 | A1 | 3/2017 |
| WO | WO-2017087595 | A1 | 5/2017 |
| WO | WO-2017190120 | A1 | 11/2017 |
| WO | WO-2017193204 | A1 | 11/2017 |
| WO | WO-2019195651 | A1 | 10/2019 |
| WO | WO-2020028852 | A1 | 2/2020 |
| WO | WO-2020028853 | A1 | 2/2020 |
| WO | WO-2020028856 | A1 | 2/2020 |
| WO | WO-2020028858 | A1 | 2/2020 |
| WO | 2021109532 | | 6/2021 |
| WO | WO-2022016168 | A1 | 1/2022 |
| WO | 2025006349 | | 1/2025 |

OTHER PUBLICATIONS

"U.S. Appl. No. 16/098,160, Final Office Action mailed Apr. 30, 2020", 7 pgs.

"U.S. Appl. No. 16/098,160, Non Final Office Action mailed Sep. 30, 2019", 8 pgs.

"U.S. Appl. No. 16/098,160, Preliminary Amendment filed Nov. 1, 2018", 5 pgs.

"U.S. Appl. No. 16/098,160, Response filed Jan. 30, 2020 to Non Final Office Action mailed Sep. 30, 2019", 8 pgs.

"U.S. Appl. No. 16/098,160, Response filed Jun. 30, 2020 to Final Office Action mailed Apr. 30, 2020", 8 pgs.

"U.S. Appl. No. 16/375,927, Examiner Interview Summary mailed Apr. 24, 2020", 3 pgs.

"U.S. Appl. No. 16/375,927, Final Office Action mailed Jun. 5, 2020", 10 pgs.

"U.S. Appl. No. 16/375,927, Non Final Office Action mailed Feb. 28, 2020", 9 pgs.

"U.S. Appl. No. 16/375,927, Response filed May 27, 2020 to Non Final Office Action mailed Feb. 28, 2020", 10 pgs.

"U.S. Appl. No. 16/431,540, Non Final Office Action mailed Jun. 10, 2020", 13 pgs.

"Canadian Application Serial No. 3,022,888, Voluntary Amendment filed Jul. 12, 2019", 10 pgs.

"International Application Serial No. PCT/CA2017/000125, International Preliminary Report on Patentability mailed Nov. 22, 2018", 6 pgs.

"International Application Serial No. PCT/CA2017/000125, International Search Report mailed Aug. 14, 2017", 3 pgs.

(56) References Cited

OTHER PUBLICATIONS

"International Application Serial No. PCT/CA2017/000125, Written Opinion mailed Aug. 14, 2017", 4 pgs.
"International Application Serial No. PCT/CN2019/124443, International Search Report mailed Mar. 5, 2020", 4 pgs.
"International Application Serial No. PCT/CN2019/124443, Written Opinion mailed Mar. 5, 2020", 4 pgs.
"International Application Serial No. PCT/US2019/025942, International Search Report mailed Jun. 27, 2019", 4 pgs.
"International Application Serial No. PCT/US2019/025942, Response filed Feb. 5, 2020 to Written Opinion mailed Feb. 27, 2019", 14 pgs.
"International Application Serial No. PCT/US2019/025942, Response filed Apr. 23, 2020 to Written Opinion mailed Apr. 23, 2020", 14 pgs.
"International Application Serial No. PCT/US2019/025942, Written Opinion mailed Feb. 24, 2020", 8 pgs.
"International Application Serial No. PCT/US2019/025942, Written Opinion mailed Jun. 27, 2019", 9 pgs.
"International Application Serial No. PCT/US2019/044974, International Search Report mailed Oct. 24, 2019", 6 pgs.
"International Application Serial No. PCT/US2019/044974, Response filed Jun. 2, 2020 to Written Opinion mailed Oct. 24, 2019", 13 pgs.
"International Application Serial No. PCT/US2019/044974, Written Opinion mailed Jun. 19, 2020", 7 pgs.
"International Application Serial No. PCT/US2019/044974, Written Opinion mailed Oct. 24, 2019", 6 pgs.
"International Application Serial No. PCT/US2019/044976, International Search Report mailed Oct. 18, 2019", 5 pgs.
"International Application Serial No. PCT/US2019/044976, Response filed Jun. 3, 2020 to Written Opinion mailed Oct. 18, 2019", 11 pgs.
"International Application Serial No. PCT/US2019/044976, Written Opinion mailed Oct. 18, 2019", 8 pgs.
"International Application Serial No. PCT/US2019/044979, International Search Report mailed Oct. 22, 2019", 6 pgs.
"International Application Serial No. PCT/US2019/044979, Response filed Jun. 3, 2020 to Written Opinion mailed Oct. 22, 2019", 12 pgs.
"International Application Serial No. PCT/US2019/044979, Written Opinion mailed Oct. 22, 2019", 7 pgs.
"International Application Serial No. PCT/US2019/044983, International Search Report mailed Oct. 22, 2019", 5 pgs.
"International Application Serial No. PCT/US2019/044983, Written Opinion mailed Oct. 22, 2019", 6 pgs.
"International Application Serial No. PCT/US2020/019039, International Search Report mailed May 15, 2020", 2 pgs.
"International Application Serial No. PCT/US2020/019039, Written Opinion mailed May 15, 2020", 4 pgs.
"International Application Serial No. PCT/US2021/070786, International Preliminary Report on Patentability mailed Aug. 9, 2022", 9 pgs.
"International Application Serial No. PCT/US2021/070786, International Search Report mailed Nov. 9, 2021", 4 pgs.
"International Application Serial No. PCT/US2021/070786, Invitation to Pay Additional Fees mailed Sep. 1, 2021", 2 pgs.
"International Application Serial No. PCT/US2021/070786, Response to Written Opinion filed May 13, 2022 to Written Opinion mailed Nov. 9, 2021", 14 pgs.
"International Application Serial No. PCT/US2021/070786, Written Opinion mailed Nov. 2, 2021", 7 pgs.
"International Application Serial No. PCT US2024 035103, International Search Report mailed Sep. 19, 2024", 3 pgs.
"International Application Serial No. PCT US2024 035103, Written Opinion mailed Sep. 19, 2024", 8 pgs.
"Saudi Arabian Application Serial No. 523442143, Substantive Examination Report mailed Dec. 17, 2024", W English Translation, 17 pgs.

* cited by examiner

HORIZONTAL RACKING AND STAND BUILDING SYSTEM

CLAIM OF PRIORITY

This patent application is a U.S. National Stage Filing under 35 U.S.C. 371 from International Application No. PCT/US2021/070786, filed on Jun. 29, 2021, and published as WO 2022/016168, which application claims the benefit of priority to U.S. Provisional Application Ser. No. 63/052,150, filed Jul. 15, 2020, each of which are incorporated by reference herein in their entirety.

TECHNOLOGICAL FIELD

The present disclosure relates to a system and method for racking pipe and making up pipe stands (e.g., stand building). More particularly, the present disclosure relates to racking pipe horizontally and making up pipe stands horizontally. Still more particularly, the present disclosure relates to racking and making up pipe stands in a horizontal orientation and off of the drill floor and a system for delivering the pipes and/or pipe stands to the drill floor and directly into the well bore.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Racking of drill pipe and pipe stands as well as making up pipe stands is commonly performed on the drill rig in a vertical fashion. With respect to racking, for example, drill rigs commonly have setback areas where drill pipe or pipe stands may be arranged in vertical racks. The drill pipes or pipe stands may be placed on the drill floor and may extend upward to a racking or finger board that holds the tops of the pipes. The pipes or pipe stands may be placed there to ready them for tripping into a well or they may be placed there during tripping out operations as the drill string is removed from the well.

With respect to making up pipe stands, this process is also commonly performed on the drill rig. In some cases, the top drive and top drive elevators may be used to make up pipe stands and place them directly onto the drill string or into the setback area for later use. In other cases, offline systems may be used to make up pipe stands and place them in the setback area or deliver them to the drilling operation. One example of a system and method for offline stand building is described in U.S. patent application Ser. No. 16/098,160, filed on Nov. 1, 2018, and entitled System and Method for Offline Standbuilding, the content of which is hereby incorporated by reference in its entirety.

Racking of pipe or pipe stands and making up pipe stands in a vertical orientation can be cumbersome and has natural risks associated with instability of vertically arranged pipe. Moreover, racking of pipe or pipe stands and making up pipe stands on the drill floor consumes a lot of space.

SUMMARY

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one or more embodiments, a horizontal pipe storing and stand building system may include a pipe rack and a horizontal stand building system arranged adjacent to the pipe rack and configured to receive tubulars from the pipe rack and construct pipe stands in a horizontal orientation. The system may also include a delivery system arranged adjacent the horizontal stand building system and opposite the pipe rack. The delivery system may be configured to receive horizontally arranged pipe stands from the horizontal stand building system and deliver them to a drill rig.

In one or more other embodiments, a method of offline stand building may include receiving a first horizontally arranged tubular in a lateral direction and translating the first tubular longitudinally to an outboard side of a pipe coupling device. The method may also include receiving a second horizontally arranged tubular in a lateral direction and coupling the first tubular to the second tubular using a pipe coupling device to create a pipe stand.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which

DETAILED DESCRIPTION

The present disclosure, in one or more embodiments, relates to a horizontal racking and pipe stand building system. The system may include devices and systems for horizontally storing, handling, building, and delivering pipe or pipe stands that may be used in a drill string of a drill rig. The system may have areas for horizontally storing singles, doubles (e.g., two-pipe stand), triples (e.g., three-pipe stand), or other length pipe stands. The system may also include a horizontal stand building system for making up pipe stands and immediately passing them to a delivery system or staging them for later delivery (e.g., racking). The delivery system may be adapted to receive horizontally arranged singles, doubles, triples, or other pipe stand lengths and deliver the pipe or pipe stands to the drill floor. The system may, thus, allow for safe storage and offline stand building and may free up space on the drill floor for other activities or allow for a smaller drill floor due to the racking and stand building being off of the drill floor. Still further, and since the setback area is not present on the rig, the rig associated with this racking system can be configured as a singles, doubles, or triples rig by the addition or removal of mast sections. For example, the rig may be reconfigured between rig moves or between drilling jobs.

Figure 1:
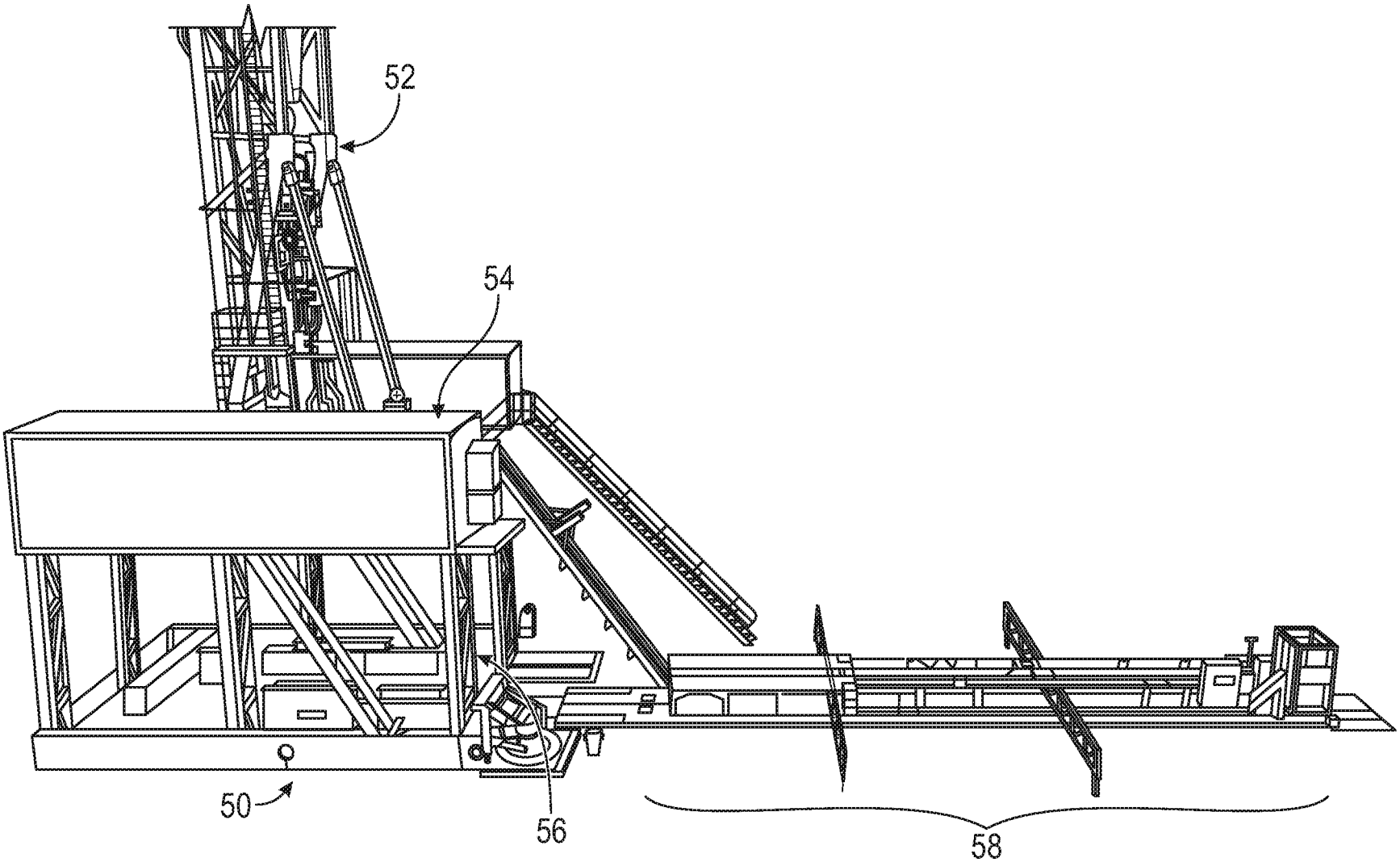
FIG. 1 is a perspective view of a drill rig and a pipe handling system.

FIG. 1 shows a drill rig 50 having a mast 52, a drill floor 54, and a support structure 56. The drill rig 50 may be supplemented with a pipe delivery system 58 that may deliver pipe, one-by-one, from a storage location, and to the drill floor. As described in more detail below, the rig 50 may alternatively be supplemented with a horizontal racking and stand building system 100 capable of building and storing singles, doubles, or triples, for example, and delivering the same to the drill floor 54.

Figure 2:
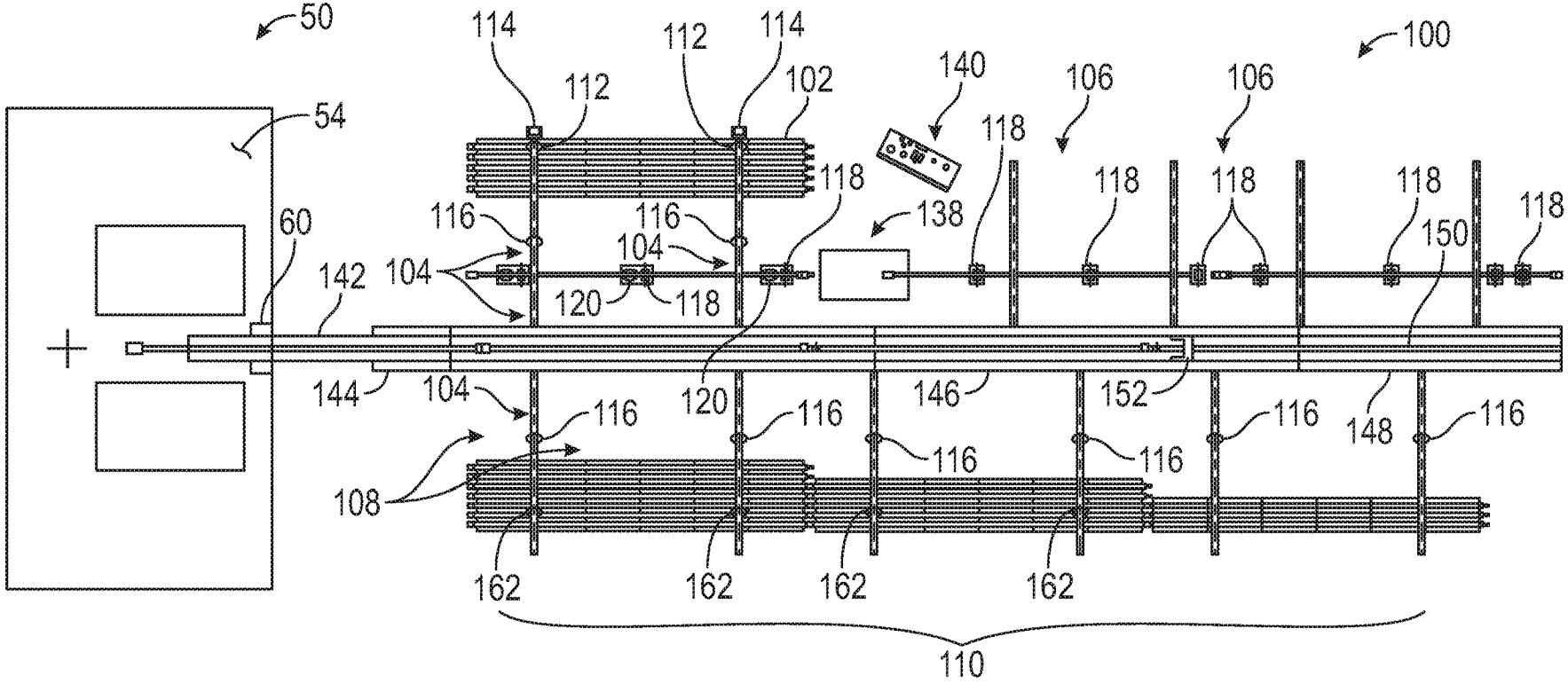
FIG. 2 is a plan view of a horizontal racking and stand building system for use in conjunction with a drill rig such as that of FIG. 1, according to one or more embodiments.

FIG. 2 shows a plan view of a horizontal racking and stand building system 100, according to one or more embodiments. As discussed above, the system may be adapted for storing single lengths of pipe, building and storing pipe stands, and delivering pipe and/or pipe stands to a drill rig for drilling operations. The system may also include devices and systems for handling the pipe and/or pipe stands between, or during operations in, the storage, building, and delivery systems. In one or more embodiments, the horizontal racking and stand building system 100 may include a pipe rack 102, one or more handling systems 104, a stand building system 106, a delivery system 108, and a pipe stand rack 110. Each of these elements is described in more detail below.

With continued reference to FIG. 2, a pipe rack 102 may be provided. As shown, the pipe rack 102 may be arranged relatively close to the drill rig 50 and may be configured for storing and/or transporting single lengths of drill pipe, drill collar, and/or casing. For example, the horizontal racking and stand building system 100 may have a first or inboard end defined by the ramp end of the delivery system 108 and a second or outboard end opposite the first end. The first end may be adapted for arrangement adjacent a drill rig, for example, such that the ramp of the delivery system may deliver tubulars to the drill floor. In the one or more embodiments, the pipe rack 102 may be arranged at the first or inboard end of the system. As will become apparent through a review of the present description, this may be advantageous for making single tubulars readily accessible to the drill rig. This layout may also result in building pipe stands by adding pipe to an inboard end of the pipe and then translating them outward away from the rig to add additional pipes.

Regarding the details of the pipe rack 102, in one or more embodiments, drill pipe, drill collar, and/or casing (e.g., tubulars) may range in length from 10 feet to 90 feet, or from 20 feet to 40 feet, or from 25 feet to 35 feet. In one or more embodiments, tubular may be approximately 30 feet. In view of this, the pipe rack 102 may have length of approximately 30 feet or a length slightly shorter may be used such that supporting members of the rack are arranged within the tubular body allowing the box end and the pin end to hand off the end of the rack 102, for example. The rack 102 may include generally horizontal supporting members 112 that may be cantilevered off of vertical supporting posts 114 positioned on one side of the pipe rack 102. That is, the pipe rack may include shelves for creating layers of piping. The shelves may be formed from several spaced apart horizontal supporting members 112. The supporting members 112 may be arranged generally transverse to the longitudinal axis of the tubulars so as to provide intermittent support along the length of the tubular. The supporting members may have a first end and a second and may be supported by a post 114 or frame at one of the first and second end forming a cantilevered support for the tubulars. A series of shelves may be provided in this manner such that tubulars may be selectively rolled or slid off of the shelves onto transfer rails, for example. In one or more embodiments, the supports of the rack may be tipped upward to secure the pipes or other tubulars in the rack and may be tipped downward to release pipes from the rack. In one or more embodiments, the pipe rack may be configured as a trailer having a frame and axles supporting the rack. In this manner, empty racks may be readily changed out with full racks to continue supplying pipe to the operation.

As mentioned, the system may include one or more handling systems 104 for managing the movement of tubulars between the several systems and/or during operations in the several systems. As mentioned, and as shown in FIG. 2, one such handling device 104 may include a rail system extending from the pipe rack 102 to the stand building system 106, an additional rail system extending from the stand building 106 system to the delivery system 108, and still another rail system from the delivery system 108 to the pipe stand rack 110. In one or more embodiments, the several rail systems may be continuous rail systems with catches for stopping the movement of tubulars at a respective system along the rail. The rail system may include two or more rails 116 extending generally transverse to the longitudinal axes of the tubulars. The rails may be supported on upright supports or frames and may be in the form of generally continuous members or several spliced together members. The rail may include a substantially flat top surface allowing for rolling support of the tubulars. The rail may be, for example, a pipe, tube, angle, or other structural shape, for example.

In one or more embodiments, the rail systems may include conveying systems for sliding or otherwise moving the pipe or pipe stands laterally along the rails. In one or more embodiments, the rails may be equipped with rollers that may be passive or active rollers for moving the pipe along the rails. In one or more other embodiments, a belt arranged adjacent to the rail may include cleats or other protrusions that extend upward adjacent the rail and above the rail to engage the side of the pipe or other tubular. The rotation of the belt may move the cleat causing the cleat to push on the pipe or other tubular and displace it along the rail. In other embodiments, the rail may be sloped and movement of the tubular along the rail may be caused by gravity.

In one or more embodiments, the handling systems may be supported on adjustable height supports and the rails of the system may overlap with other aspects of the racking and pipe stand building system. As such, the rail system may carry a pipe or pipe stand into an area of another operation, stop the pipe or pipe stand from continued lateral displacement, and lower the pipe onto the respective system for further steps. In one or more embodiments, the handling system may be adapted to hand the pipe or pipe stand off to another handling system when, for example, bypassing a particular aspect of the racking and stand building system.

With continued reference to FIG. 2, a stand building system is shown 106. The stand building system 106 may be arranged generally between the pipe rack 102 and the delivery system 108. As such, the system may be positioned to receive pipes from the pipe rack 102, construct pipe stands, and pass the pipe stands on to the delivery system 108 or to the pipe stand rack 110 situated on the other side of the delivery system 108. The stand building system 106 may be a horizontally arranged system of supports and devices configured for connecting tubulars end-to-end to create pipe stands. The pipe stands may be two or three singles connected end-to-end to form doubles or triples, respectively. Still other numbers of singles may be connected end-to-end to form pipe stands.

As shown, the stand building system 106 may include one or more driving devices 118 and one or more guiding devices 120. The driving devices 118 may be configured to drive tubulars along their longitudinal axis. The guiding devices 120 may be configured for maintaining the lateral position of the tubulars as they move longitudinally or as they rotate. As shown in FIG. 3 and again in FIGS. 12 and 13, in one or more embodiments, these driving and guiding devices may be provided in conjunction with one another. Alternatively, these devices may be provided in isolation from one another along an axis where pipe stands are to be built.

Figure 3:
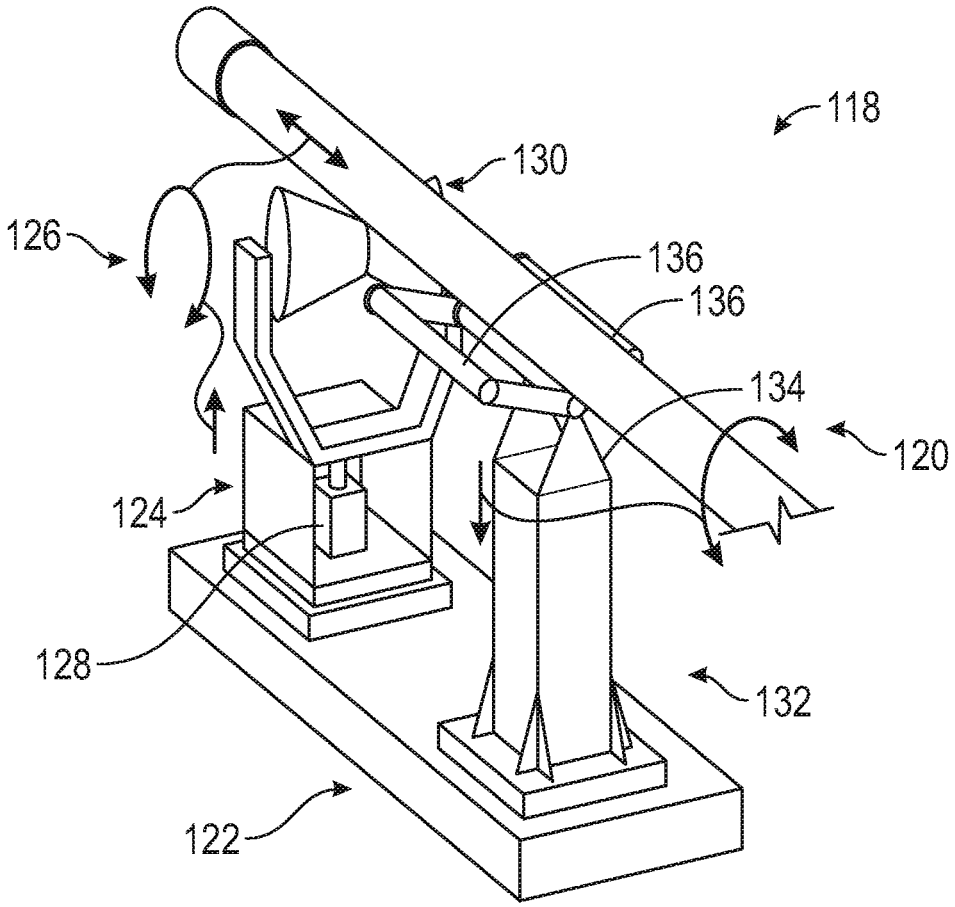
FIG. 3 is a perspective view of a pipe transfer device, according to one or more embodiments.
Figure 12:
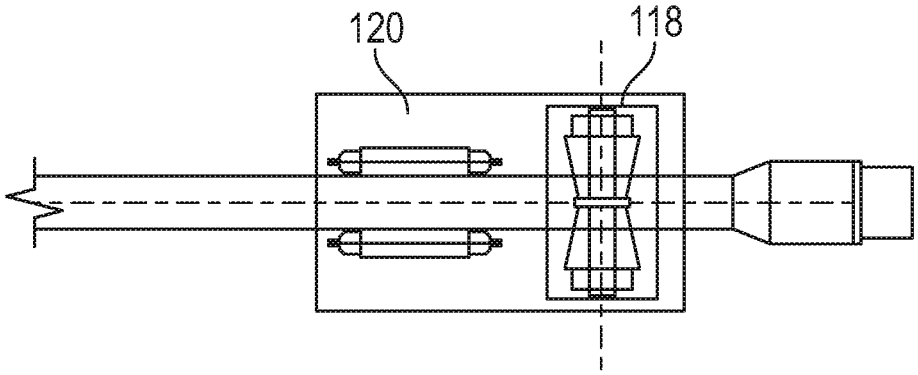
FIG. 12 is a top view of the pipe transfer device of FIG. 3, according to one or more embodiments.
Figure 13:
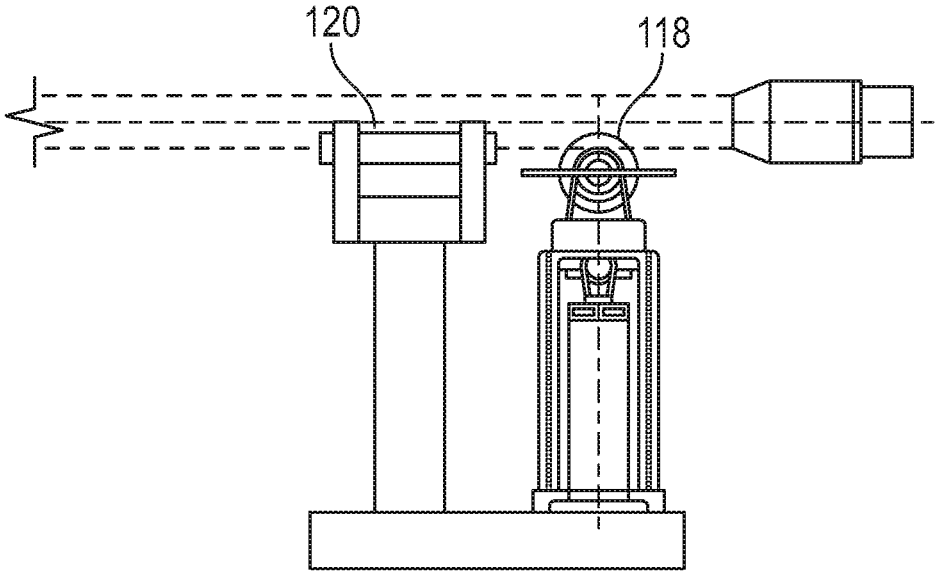
FIG. 13 is a side view of the pipe transfer device of FIG. 3, according to one or more embodiments.

As shown in FIG. 3 and in FIGS. 12 and 13, providing these devices in conjunction with one another may involve providing them on a shared platform or foundation, for example. In one or more embodiments, the devices may be included on a shared trailer, for example. The platform, foundation, or trailer may include a base 122 adapted for placement on the ground or other supporting surface. For example, as mentioned, a trailer may be provided. Alternatively, a steel skid, frame, or other steel structure, or concrete base 122 may be provided. In one or more embodiments, the base 122 may be sized to accommodate one or more driving or guiding devices.

As mentioned, the driving devices 118 may be active devices configured to drive tubulars along their longitudinal axis, for example. As shown in FIG. 3, the driving devices 118 may include a stand portion 124 and an engagement portion 126. The stand portion 124 may be secured to the base 122 and may be adapted to hold the tubulars at a selected height. For example, the stand portion 124 may be adjustable to raise and lower the engagement portion 126. In one or more embodiments, the stand portion 124 may include a hydraulic lift, a screw-based lift, or another actuatable device 128 for articulating to extend or retract. The engagement portion 126 may be adapted to engage the pipe or other tubular and may also be adapted to move the tubular along its longitudinal axis. The engagement portion 126 may include a wheel, belt, shaker plate, pulley, or other driven element 130 for engaging and advancing the tubular. The driven element 130 may have an electric motor, for example, in electrical communication with a power source such as a generator or other electric power source, for example. In one or more embodiments, the driven element 130 may include a v-roller having two conical sides each tapering toward a center of the roller and forming a V-shape when viewed across the rolling axis of the roller. The V-shape may assist to maintain the lateral position of the tubular as the tubular is translated along its longitudinal axis.

With continued reference to FIG. 3, the guiding device 120 may be a passive device configured to hold the tubulars and allow the tubulars to rotate about their longitudinal axis. As shown, the guiding devices 120 may be stationary devices and may include a column 132 secured to the base 122 and extending upward to a pair of opposing u-shaped or v-shaped brackets 134. The brackets 134 may be substantially rigidly supported by the column 132 and may be spaced apart from one another along the longitudinal axis of the tubular with passive rollers 136 extending therebetween. That is, one or more rollers 136 may be arranged with their rolling or longitudinal axis parallel to the tubular so as to support the weight of the tubular and roll with the tubular as the tubular is rotated. The guiding devices 120 may be stationary, fixed height devices. Alternatively, the guiding devices 120 may be adjustable in height like the driving devices 118.

Referring back to FIG. 2, the stand building system 106 may include an iron roughneck, bucking unit, or other pipe or tubular coupling device 138. In one or more embodiments, the tubular or pipe coupling device 138 may include adjacent jaws or wrenches arranged in a generally vertical plane with their jaw openings facing the pipe delivery system, for example. The jaws may be adjacent in a direction parallel to the longitudinal axis of the tubulars. The jaws may be stationary laterally and longitudinally relative to the longitudinal axis of the stand building system 106 or they may be articulable laterally relative to the longitudinal axis of the tubulars so as to engage the tubulars and disengage the tubulars laterally or from the side. The pipe coupling device 138 may be configured to spin a tubular relative to another tubular to advance a threaded pin end of one tubular into a threaded box end of another tubular. The device 138 may also be configured to torque the joint to provide sufficient tightness to the joint to maintain a secure connection between pipes or tubulars within a pipe stand. As may be appreciated, the pipe coupling device 138 may be adapted to break pipe connections in the opposite manner by providing sufficient torque to a pipe joint to release one pipe from another and then unspin the pin end from the box end.

As shown in FIG. 2, the stand building system 106 may include a plurality of driving units outboard 118 from the pipe coupling device. The driving units 118 may be spaced apart by a distance slightly less than half the length of a tubular or another selected spacing. In one or more embodiments, the spacing may be selected such that three driving units may be supporting each pipe of a pipe stand, for example.

As also shown in FIG. 2, the stand building system 106 and/or the entire racking/stand building system may include an operator station 140. The operator station 140 may include a console for a user to control operations of the racking and/or stand building system 100. That is, the console may include a computer interface and/or controls for controlling the release of singles from the pipe rack 102. The console may include controls for operating the stand building system 106 to shift pipes longitudinally, connect them end to end, and to eject them to the delivery system 108 and/or across the delivery system 108 to the pipe stand rack 110. Still other operations may be provided to perform the various methods of operation described in more detail below.

With continued reference to FIG. 2 and with reference to FIGS. 4-7, the delivery system 108 may be described. As shown in FIG. 2, an additional handling system 104 may be provided for transferring pipes or pipe stands from the stand building system 106 to the delivery system 108. As shown, the delivery system 108 may include a pipe cat for receiving pipes, other tubulars, and/or pipe stands from the stand building system 106 via a handling system 104. The delivery system 108 may further be adapted for delivering pipes or other tubulars or pipe stands to the drill rig 50 or passing them on to the pipe stand rack 110. In one or more embodiments, the delivery system 108 may include a ramp 142, a base portion 144, and first and second extension portions 146, 148.

The ramp 142 of the delivery system 108 may be configured for guiding a leading end of the tubular up to the drill floor 54. The ramp 142 may be a generally sloping structure leading from the base 144 up to the drill floor 54. The ramp 142 may include a groove, trough, or other guiding recess in a surface thereof. The guiding recess may be generally centered on the ramp and may extend longitudinally along substantially the full length of the ramp. The ramp may be arranged to align with a v-door or other opening 60 on a drill floor so as to feed pipes or pipestands to a location where they are retrievable by a top drive elevator or other pipe handling system on the drill floor 54.

The base 144 of the delivery system 108 may be configured for supporting tubulars in a laying down or horizontal orientation and for advancing the tubulars toward the drill rig. As such, the base 144 may include a groove, trough, or other guiding recess in a surface thereof. The guiding recess may be centered on the base and may extend longitudinally along substantially the full length of the base. The guiding recess on the base may be substantially aligned with the guiding recess on the ramp 142. Still further, the base 144 may include a pusher slot 150 and a pusher 152 (moveable across the base 144, first extension 146, and second extension 148 and shown on second extension in FIG. 2). That is, the base 144 may include a pusher configured for advancing tubulars along the length of the base 144 by pushing them on the pin end of the tubular, for example. The pusher 152 may be a powered element arranged generally inside the base 144 with a hook, tab, or finger, for example extending upward through the pusher slot 150. The pusher 152 may be chain, wire rope, or screw driven system within the base 144. For example, a chain or wire rope drive may provide for pulling the pusher along the bases. Alternatively, a screw drive may engage a pusher body and rotation of the screw may cause the pusher body to translate along the base 144 relative to a stationary screw. The pusher may include guide rods and the pusher body may include sleeves or jaws with bushings for sliding along the guide rods thereby controlling orientation and twisting of the pusher body. The pusher body may be arranged below and centered on the guiding recess and the mentioned hook, tab, or finger may extend upward through the pusher slot 150. A carriage may be positioned on the hook, tab, or finger and may be adapted for nesting around a pin end of a pipe or pipe stand allowing the pusher to advance a pipe or pipe stand along the base 144, up the ramp 142, and toward the drill floor 54, for example. While a chain, wire rope drive, and a screw drive system have been described for the pusher 152, still other approaches to providing a pusher on the base may be provided.

The base 144 may include a power source 154 arranged at or near a drill floor end of the base 144. This may allow for providing power to the system at a location generally proximate to the drill rig. The power source 154 may be an electric power generator or other source of power and may be the same power source used for the stand building system 106. In one or more embodiments, the base may be fed power from the rig electrical power system or from the rig hydraulic main line, for example. In one or more embodiments, both electrical power and hydraulic power may be received from the rig and used as appropriate. For example, electrical power may be used for controls and hydraulic power may be use for higher power requirements such as heavy duty power, lifting, actuation, and the like.

Figure 4:
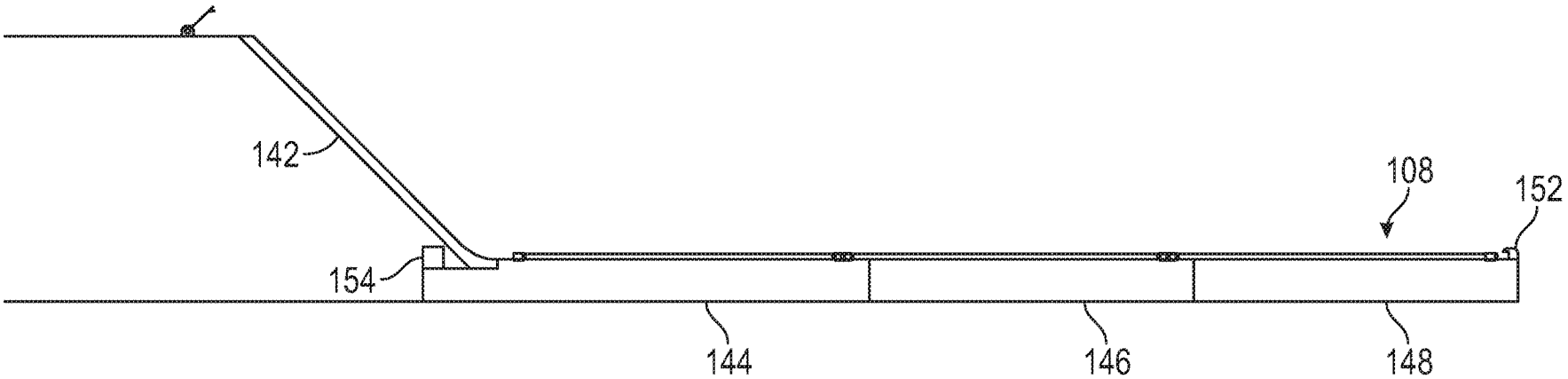
FIG. 4 is a side view of a pipe delivery system portion of the horizontal racking and stand building system, according to one or more embodiments.
Figure 5:
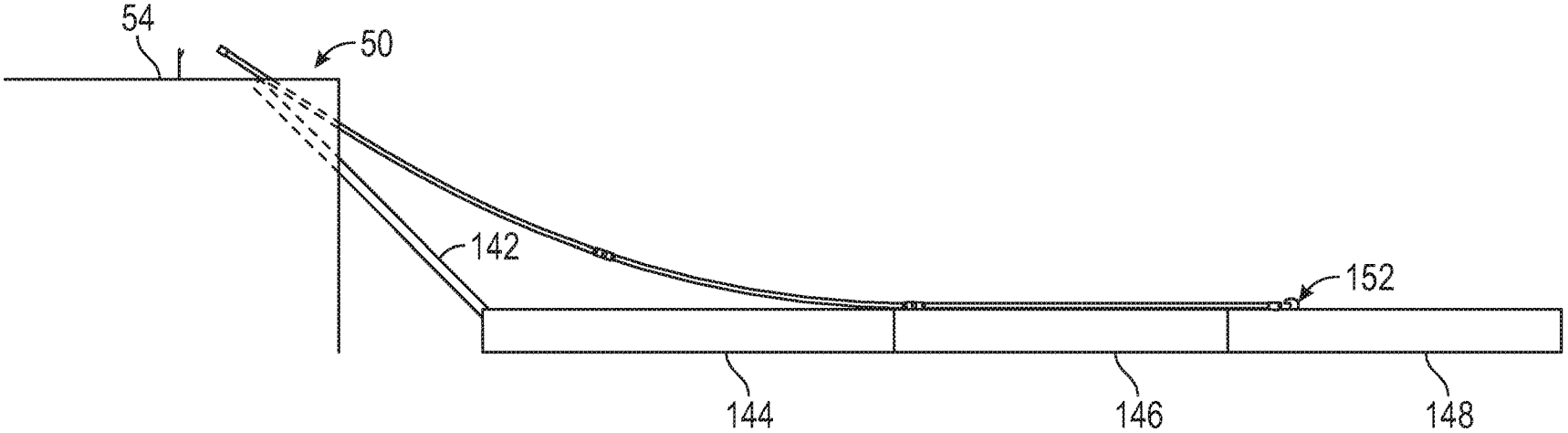
FIG. 5 is another side view with a triple stand of pipe advanced toward the drill floor, according to one or more embodiments.
Figure 6:
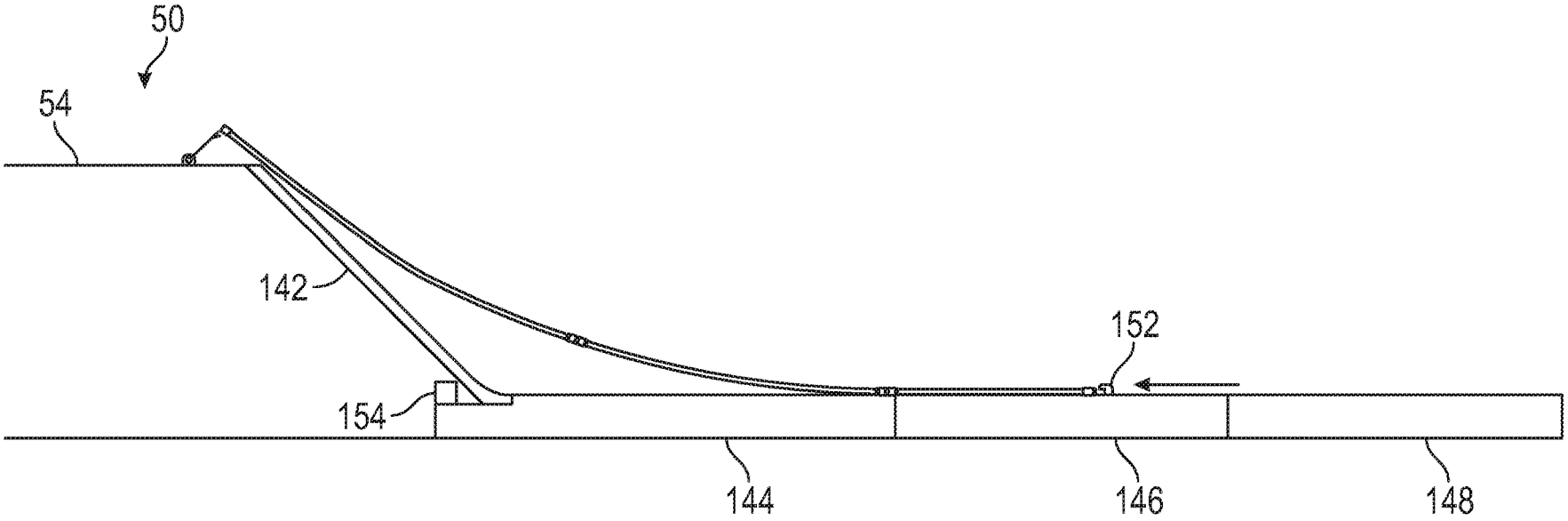
FIG. 6 is another side view with the triple stand of pipe advanced further toward the drill floor, according to one or more embodiments.
Figure 7:
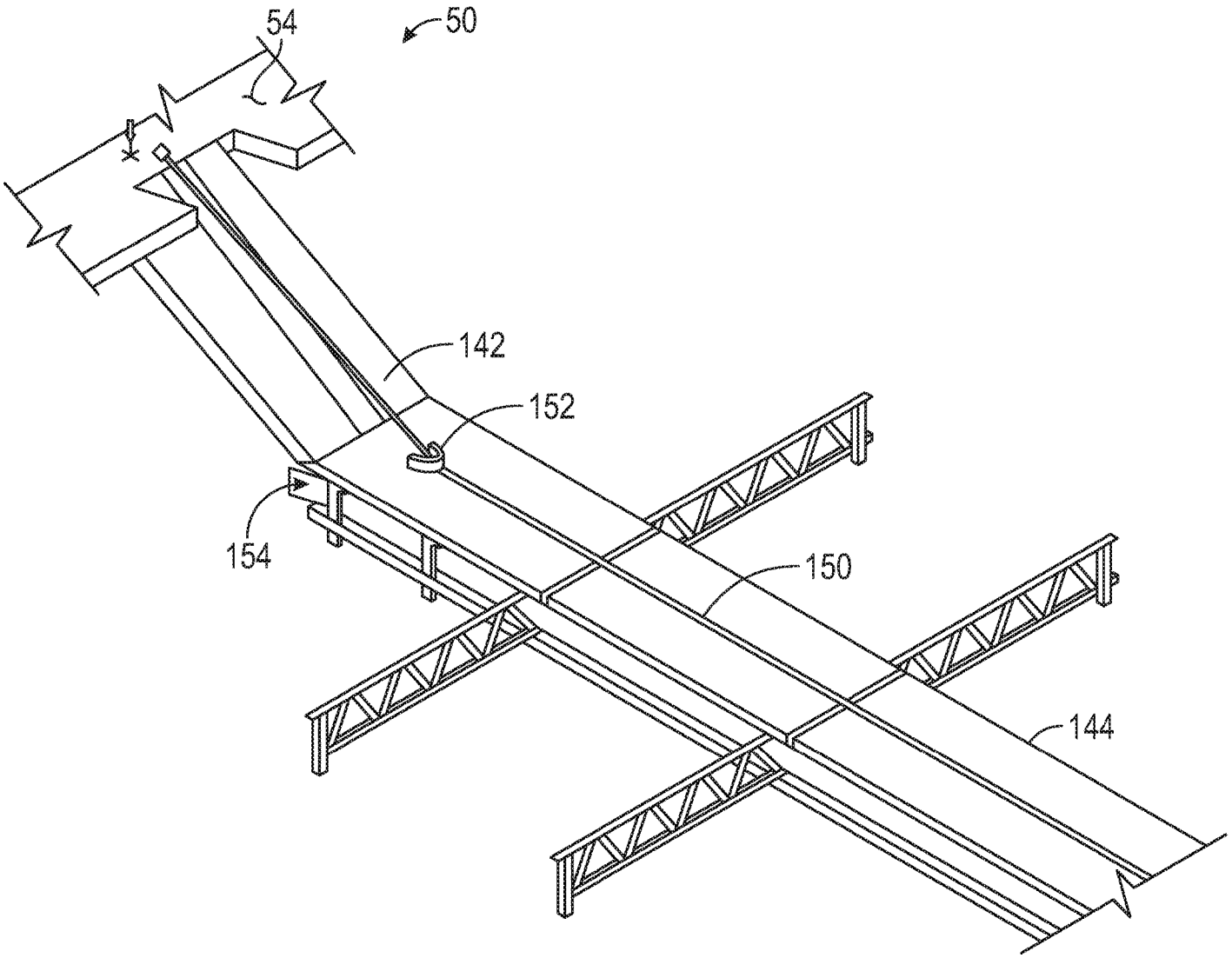
FIG. 7 is a perspective view of the ramp portion of the pipe delivery system and handling a single length of pipe, according to one or more embodiments.

The first and second extensions portions 146, 148 may include systems that are the generally the same as the base 144. Moreover, the extension portions 146, 148 may be coupleable to the base 144 in daisy chain fashion. Each extension may include pusher mechanisms adapted to couple with the base's or other extension's pusher mechanism such that a single pusher 152 may translate along the full length of the base 144, the first extension 146, and the second extension 148 depending on how many extensions are provided. As shown in FIGS. 4-6, the base 144, first extension 146, and second extension 148 may each have a length that is the same or similar to a pipe length or slightly longer. For example, the base 144, first extension 146, and second extension 148 may have a length of approximately 20 feet to approximately 50 feet, or from approximately 25 feet to approximately 40 feet, or a length of approximately 35 feet may be provided.

As shown, the base 144, first extension 146, and second extension 148 may allow for receiving a pipe stand from the stand building system 106 (FIG. 4), advancing the stand toward the drill rig 50 (FIG. 5), and advancing the leading end of the pipe stand to a retrieval location above the drill floor 54 (FIG. 6). Moreover, while the base 144, first extension 146, and second extension 148 may be adapted for feeding pipe stands to the drill floor, the system may remain capable of feeding singles to the drill floor as well. As shown in perspective view in FIG. 7, the delivery system 108 may receive a single pipe from the pipe rack 102 and handling system 104 and the pusher 152 may be used to push the single pipe up the ramp 142 such that a leading end of the pipe extends through a v-door 60, for example and reaches a retrieval position above the drill floor 54.

Referring again to FIG. 2, a pipe stand rack 110 is shown. The pipe stand rack 110 may be configured for receiving, singles, doubles, triples, or other pipes or pipe stands and storing them in an accessible location ready for delivery to the drill rig 50 for drilling or other operations. That is, as shown, while the rack 110 is labeled a pipe stand rack 110 because it can store pipe stands that are much longer than single pipes, the rack may be used to store all of the above (e.g., singles, doubles, triples, etc.). In one or more embodiments, the pipe stand rack 110 may simply be an extension of the handling system 104 used to handle the pipes or pipe stands from the delivery system to the pipe stand rack 110. That is, the pipe stand rack 110 may include laterally extending rails establishing a pipe bed and allowing the several pipes and pipe stands to be placed lateral to the delivery system 108 creating a single plane of stored pipes and pipe stands. Alternatively, the various types of tubulars stored on the pipe stand rack may each be retrievable by grouping the particular types of tubing together and making them readily accessible (e.g., without moving other tubulars out of the way first). That is, in one or more embodiments, the various tubulars may be racked on different levels of the pipe stand rack 110 such that each shelf, so to speak, of tubulars is accessible via a rail system to and from the delivery system. That is, similar to that described with respect to the pipe rack 102, the pipe stand rack 110 may include multiple shelves created by spaced apart laterally extending supports 162. The handling system 104 between the delivery system 108 and the pipe stand rack 110 may be adjustable in height to feed and retrieve the pipe stands or pipes to or from selected levels of the pipe stand rack 110. As with the pipe rack 102 described above, the laterally extending supports of the pipe stand rack 110 may be cantilevered from one side to a free end so as to allow the shelves to be positioned one above the other without obstructing lateral access to the shelves. Still other support systems may be used. Additionally or alternatively, the supports of the pipe stand rack may be tipped upward to secure the carried pipes or pipe stands in the rack and may be tipped downward to cause the pipe or pipe stands to be released.

Figure 8:
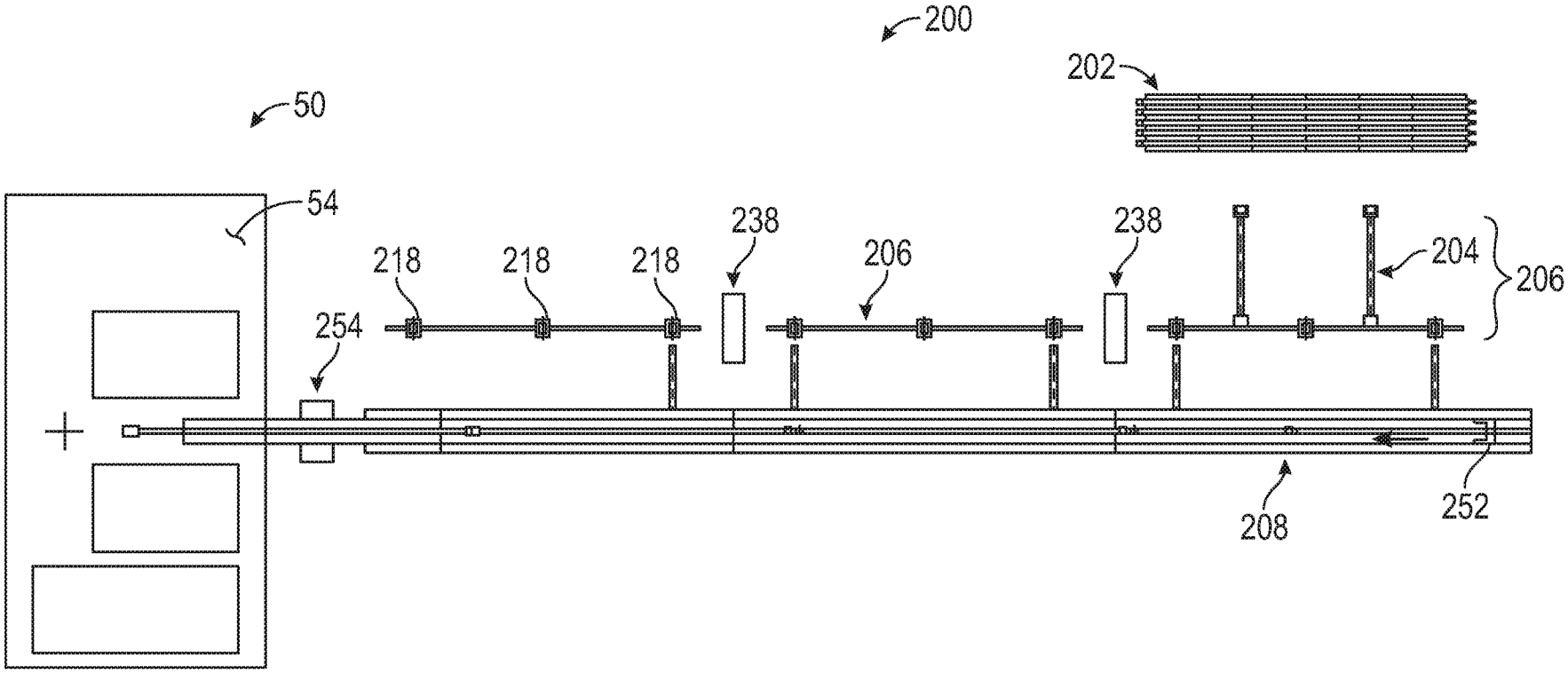
FIG. 8 is a plan view of another horizontal racking and stand building system for use in conjunction with a drill rig such as that of FIG. 1, according to one or more embodiments.

FIG. 8 is a plan view of another racking and stand building system 200, according to one or more embodiments. In this embodiment, the pipe rack 202 may be positioned a bit further from the drill rig 50 and at or near an opposite end of the stand building system 206. In this embodiment, the pipe stands may be constructed by placing a pipe from the pipe rack 202 on the stand building system 206, advancing it toward the drill rig with driving devices 218, and filling in behind it to create pipe stands. This is in contrast to the direction of the pipe stand building discussed below. Either option may be used. As shown, pipe stand building system 206 may include driving devices 218 and pipe coupling devices 238 and a handling system 204 may be provided. In addition, the pipe delivery, system 208 may include a pusher 252 and the system may include a power source 254 and may be configured for delivering pipes, pipe stands, or other tubulars to the drill floor 54. Other similarities between system 100 and 200 may be provided.

Figure 9A:
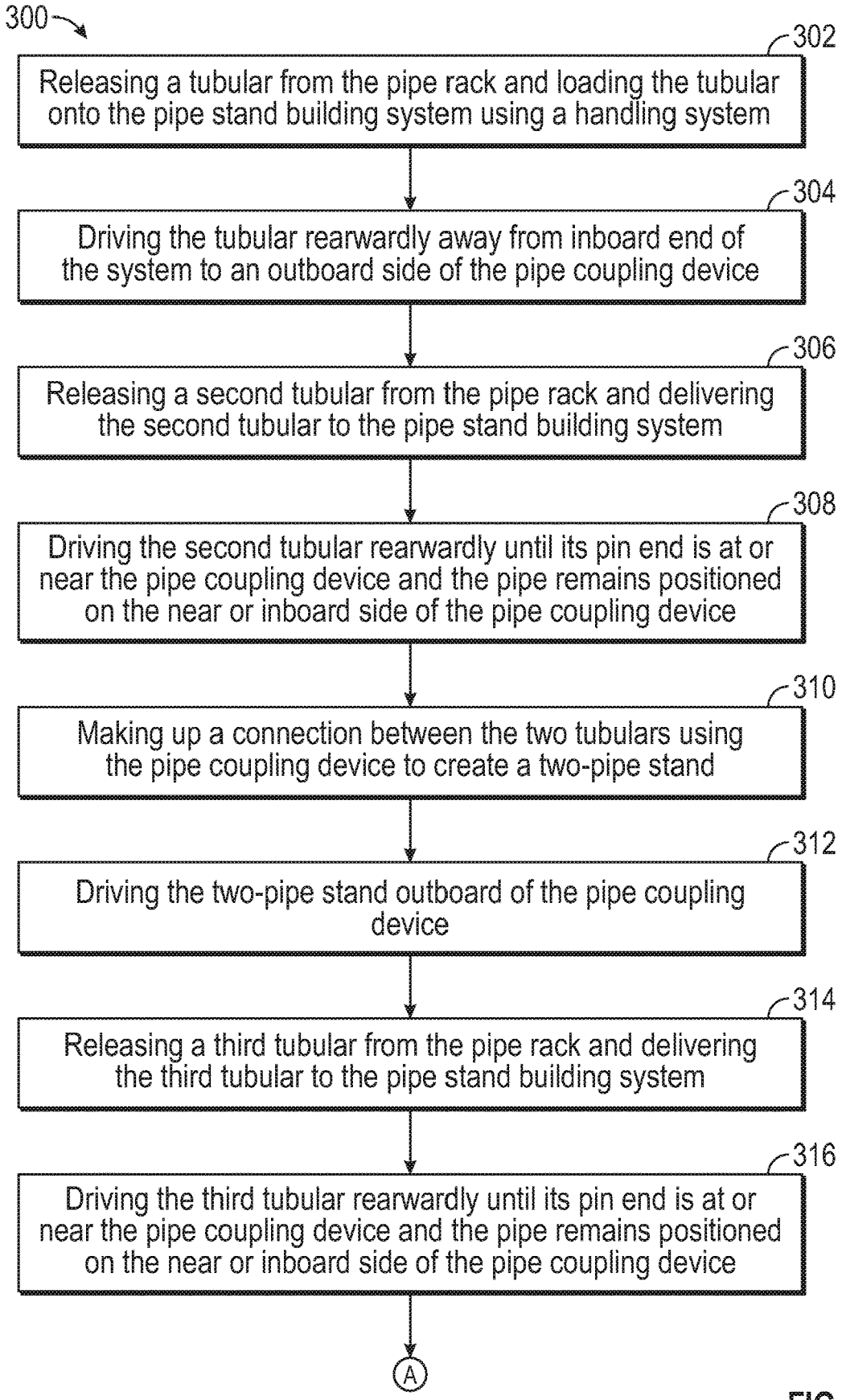
FIG. 9A is a partial flowchart depicting one or more portions of a method of operation of the racking and stand building system, according to one or more embodiments.
Figure 9B:
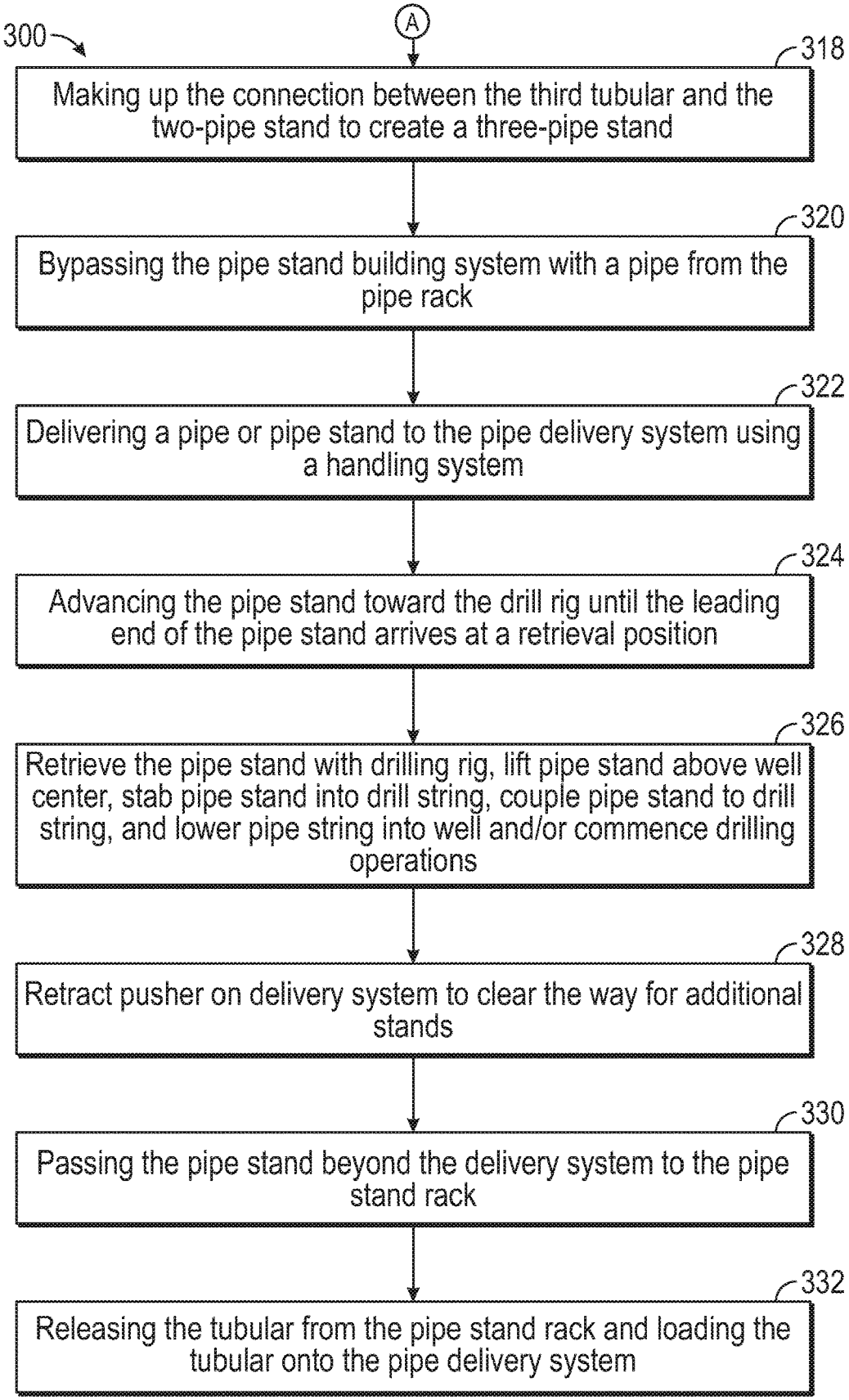
FIG. 9B is a partial flowchart depicting one or more portions of a method of operation of the racking and stand building system, according to one or more embodiments.

In operation and use, a method 300 of racking and/or stand building may be provided. While a single flow diagram is shown at FIGS. 9A and 9B, various methods are present in the diagram and nothing shall be construed to suggest that only one method is disclosed or that portions of the method could not be used in isolation from an overall method. In one or more embodiments, a method of racking and/or stand building may include releasing a pipe or other tubular from a pipe rack and loading the tubular from the pipe rack onto the pipe stand building system. (302) This may include releasing a pipe from the pipe rack by releasing a catch, for example, and allowing the pipe to travel along the rails of the handling system to the pipe stand building system. Alternatively or additionally, the pipe may be actively displaced or assisted across the handling system using a conveyance device on the handling system. Where the pipe is being delivered to the pipe stand building system, the handling system may stop the displacement of the tubular with a catch. The handling system may be lowered and/or the driving devices of the pipe stand building system may be raised to lift the pipe off of the handling system and onto the driving devices. Where no other pipes are present in the pipe stand building system, the pipe may be driven rearwardly away from the drill rig using the driving devices such that the pipe is positioned on the driving devices positioned on the outboard side of the iron roughneck or other pipe coupling device. (304)

A second pipe may be released from the pipe rack and delivered to the pipe stand building system in the same manner as the first. (306) However, once the second pipe arrives on the driving devices of the pipe stand building system, it may be driven rearwardly a shorter distance until its pin end is at or near the pipe coupling device and the pipe remains positioned on the near side of the pipe coupling device. (308) The height of the driving devices carrying the second pipe may be lowered a height consistent with the guiding devices. The driving devices carrying the first pipe may be adjusted as necessary to align the longitudinal axes of the first and second pipes. The driving devices may be used to close up any gap between the pipes and stab the pin end of the second pipe into the box end of the first pipe. The driving devices on the second pipe may be lowered to leave the pipe free to rotate and supported by the guiding devices.

The pipe coupling device may engage the two pipes and spin them together as well as torque them to make up a pipe connection. (310) In one or more embodiments, the first pipe may be held substantially stationary by the pipe coupling device and the second or inboard pipe may be spun. The pipe coupling device may then release the pipes. The driving devices of the first and second pipes may lift the two-pipe stand as necessary to clear the guiding devices and may drive the pipe rearwardly placing the two-pipe stand outboard of the pipe coupling device. (312) A third pipe may be released from the pipe rack, positioned in the pipe stand building system (314), and driven to a coupling position (316) in the same manner as the second pipe. The third tubular may be and secured to the two-pipe stand in the same manner as the connection between the first and second pipes. (318)

It is to be appreciated that pipes or other tubulars leaving the pipe rack may bypass the pipe stand building system and pass directly to the delivery system or the pipe stand rack. (320) Moreover, while construction of a triple pipe stand was described, a double pipe stand may be created as well. Still other numbers of pipe stands may be constructed.

In any of the above cases, the pipe or pipe stand may be positioned on and/or picked up by a handling system to deliver the pipe to the pipe delivery system. (322) That is, the driving devices of the pipe stand building system may be lowered and/or the rail system may be raised to rest the pipe stand on a plurality of rails. The pipe stand may be fed by gravity or active means to deliver the pipe stand to the delivery system. It should be appreciated that once the pipe stand exits the pipe stand building system, additional pipes may be fed to the pipe stand building system to begin constructing an additional pipe stand.

Where the pipe stand that has been delivered to the delivery system is to be delivered to the drill rig for drilling operations, the pusher on the second extension may be used to advance the pipe stand toward the drill rig. (324) The leading end of the pipe stand (e.g., the box end of the third pipe that created the stand) may engage the ramp and may ride up the ramp toward the drill floor. The pipe stand may flex as this is occurring as shown in FIGS. 5 and 6, for example. The pusher may continue to push the pipe stand toward the rig until the leading end of the pipe stand extends through the v-door on the drill floor and to a retrieval position, To get the pipe stand to this position, the pusher may advance along substantially the full length of the second extension and a portion of the first extension. The retrieval position of the leading end of the pipe may be a position relatively close to well center and/or within reach of the top drive elevators. In one or more embodiments, the drill rig may include a dual activity top drive such as the one described in U.S. Provisional Patent Application No. 62/809,093, filed on Feb. 22, 2019, and entitled Dual Activity Top Drive, the content of which is hereby incorporated by reference herein in its entirety. The pusher may hold the pipe stand in place until the top drive elevators or other pipe handling device on the drill rig may retrieve the pipe stand. (326) Once retrieved or once grasped by the drill rig pipe handling system, the pusher may retract to clear the way for additional stands. (328)

Where a pipe or pipe stand that was built is not yet needed for drilling operations, the pipe or pipe stand may be passed beyond the delivery system to the pipe stand rack, (330) In this case, the handling system between the delivery system and the pipe stand rack may receive the pipe stand from the handling system between the pipe stand building system and the delivery system and the two systems may bypass the delivery system. The pipe or pipe stand may travel by gravity and/or an active means to move the pipe stand laterally to the pipe stand rack. Where the pipe stand rack is a flat single plane rack, the handling system may pass the pipe stand to the rack by having the ends of its rails at a same or similar elevation as the support members of the pipe stand rack. Where the pipe stand rack is a multi-shelf rack, the rails of the handling system may be adjusted upward and/or downward to align with a respective shelf of the pipe stand rack. Stops or catches may be actuated to control the speed of the moving pipe stand and controllably deliver the pipe stand to the pipe stand rack.

Where pipes, pipe stands, or other tubulars are needed for drilling operations, the pipe stand rack may release the tubular and the handling system may deliver the tubular to the delivery system. (332) That is, for example, the pipe stand rack may release a selected pipe or pipe stand based on its storage level in the rack. The pipe or pipe stand may be released onto rails of the handling system and may be passively fed back to the delivery system or active means to displace the pipe or pipe stand laterally may be used.

Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

Figure 10:
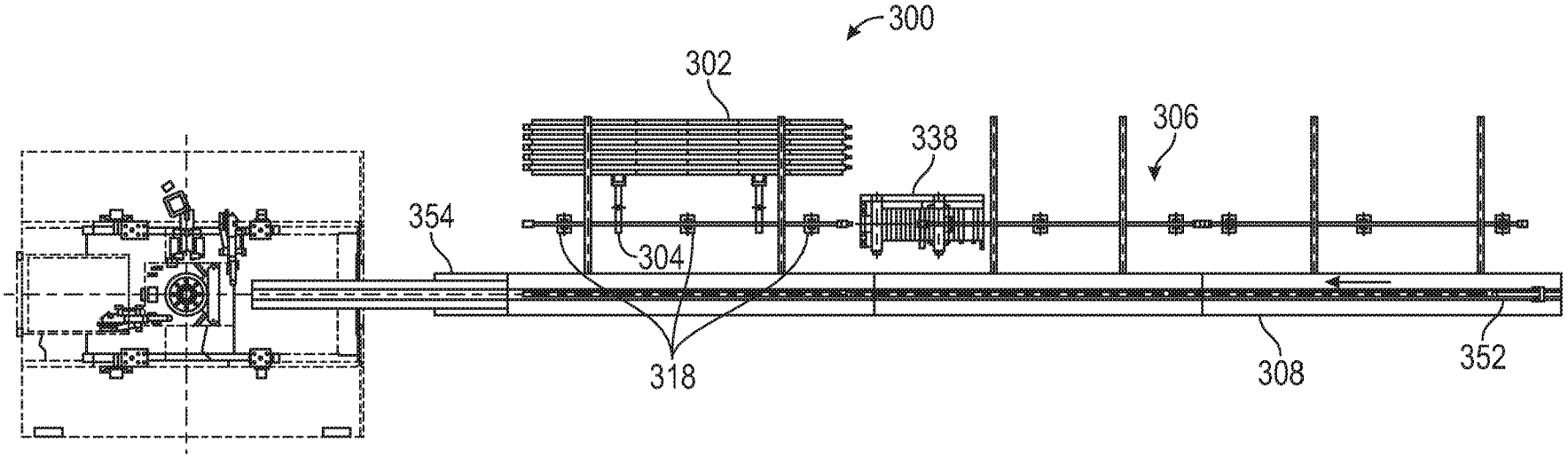
FIG. 10 is a plan view of another horizontal racking and stand building system for use in conjunction with a drill rig such as that of FIG. 1, according to one or more embodiments.

FIG. 10 is a plan view of another racking and stand building system 300, according to one or more embodiments. This embodiment may be most similar to the embodiment shown in FIG. 8. However, the pipe rack 302 may be positioned closer to the rig. As shown, the system 300 may include driving devices 318, a rail system 304, a pipe coupling device 338, a pipe cat 308, a pusher 352, a pipe building system 306, and a control system 354.

Figure 11:
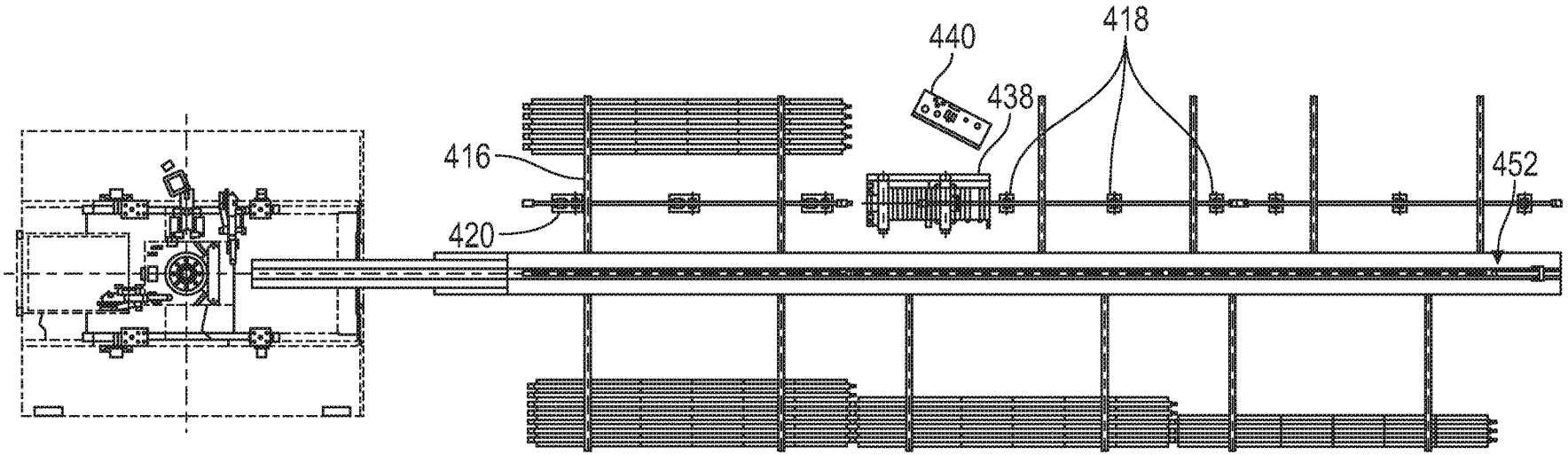
FIG. 11 is a plan view of another horizontal racking and stand building system for use in conjunction with a drill rig such as that of FIG. 1, according to one or more embodiments.

FIG. 11 is a plan view of another racking and stand building system 400, according to one or more embodiments. This embodiment may be most similar to the embodiment discussed with respect to FIGS. 1-7. As shown, the system may include pipe driving devices 418, pipe guiding devices 420, a controller 440, a pipe coupling device 438, and a pipe pusher 452.

Figure 14:
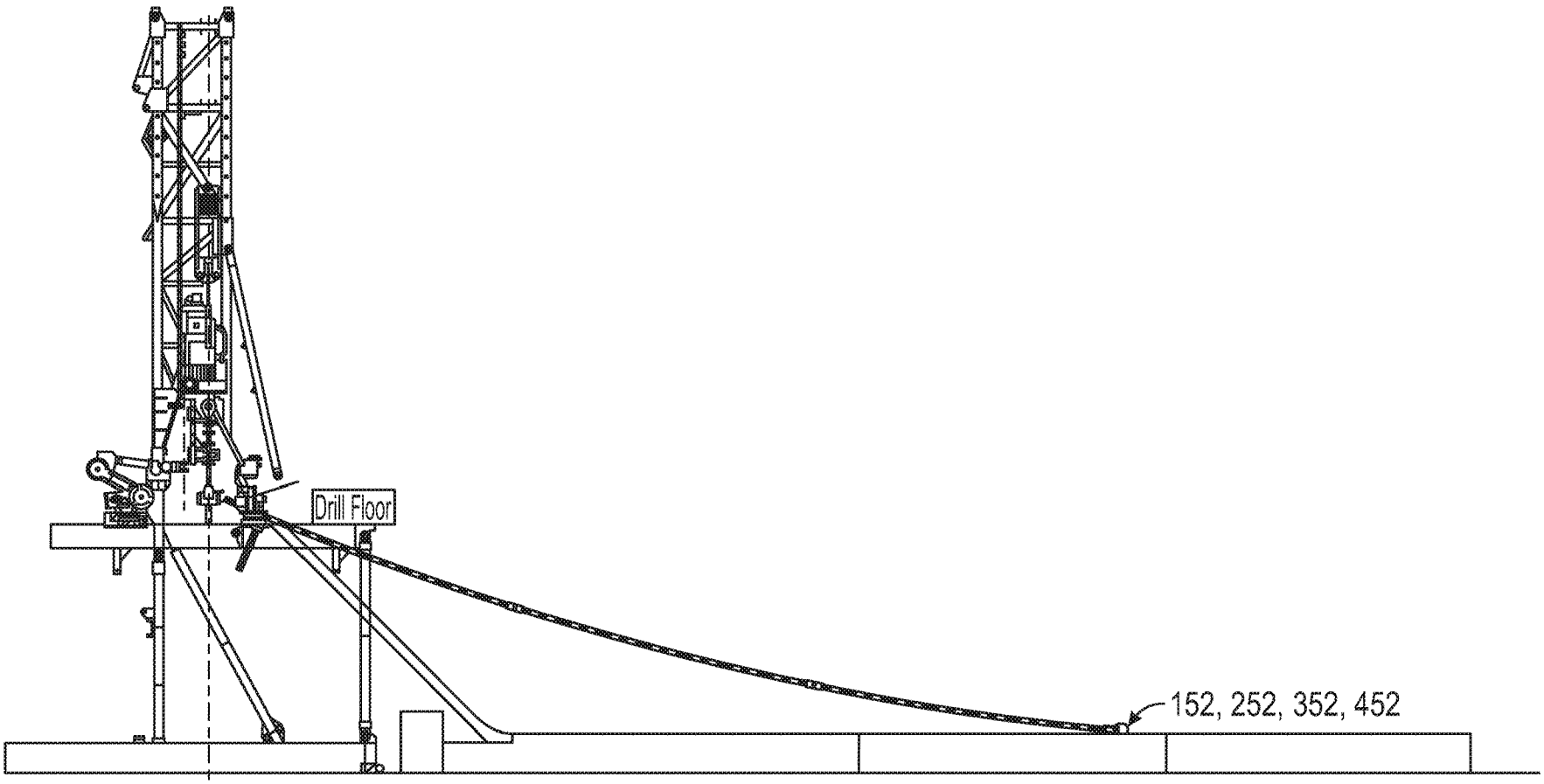
FIG. 14 is a side view with a triple stand of pipe advanced toward the drill floor, according to one or more embodiments.
Figure 15:
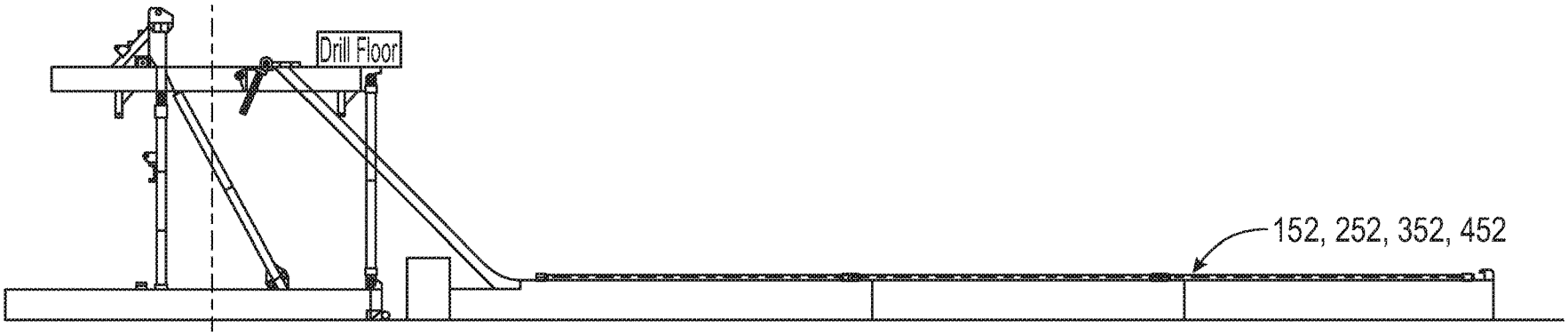
FIG. 15 is another side view with a triple stand of pipe advanced toward the drill floor, according to one or more embodiments.
Figure 16:
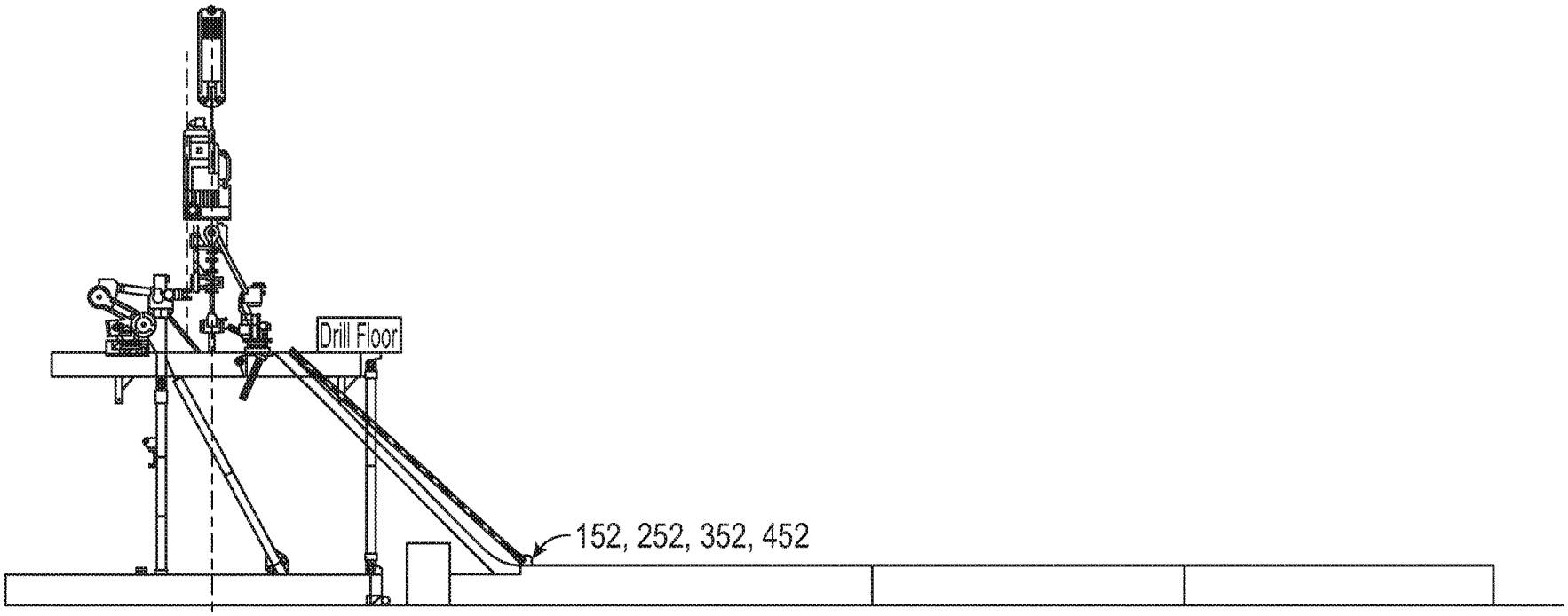
FIG. 16 is a side view with a single stand of pipe advanced toward the drill floor, according to one or more embodiments.

FIGS. 14-16 are additional views of the pushing system delivering pipes stands to the drill rig using any one of the embodiments described herein.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A horizontal pipe storing and stand building system, comprising:

a pipe rack;

a delivery system configured to receive horizontally arranged pipe stands from a horizontal stand building system and deliver them to a drill rig;

the horizontal stand building system arranged between the pipe rack and the delivery system, the horizontal stand building system configured to receive tubulars from the pipe rack, construct pipe stands in a horizontal orientation, and pass the pipe stands on to the delivery system, the horizontal stand building system comprising:

a plurality of driving devices, adjustable in height, and configured for driving a tubular horizontally along a longitudinal axis of the tubular, the plurality of driving devices each comprising a powered v-roller having a rolling axis arranged substantially orthogonal to the longitudinal axis;

a plurality of guiding devices, fixed in height, and configured for passively holding the tubulars and allowing the tubulars to rotate, the plurality of guiding devices each comprising a pair of v-shaped brackets spaced apart from one another along the longitudinal axis and having a plurality of passive rollers extending therebetween, where the plurality of passive rollers have a rolling axis extending parallel to the longitudinal axis; and a tubular coupling device; and a pipe stand rack arranged adjacent the delivery system and opposite the horizontal stand building system and having a length configured for receiving at least a two-pipe stand, wherein the plurality of driving devices are adjustable in height to vertically adjust and align axes of adjacent tubular in the horizontal stand building system and to set tubulars on and lift tubulars off the guiding devices.

2. The system of claim 1, wherein the horizontal pipe storing and stand building system has a first end and the delivery system comprises a ramp arranged at the first end.

3. The system of claim 2, wherein the pipe rack is arranged proximate to the first end.

4. The system of claim 3, wherein the horizontal stand building system is configured to build pipe stands by translating pipes in an outboard direction away from the first end and adding pipes to at a first end.

5. The system of claim 1, wherein the tubular coupling device is a roughneck.

6. The system of claim 1, wherein the delivery system comprises a ramp, a base portion, and a first extension and a second extension.

7. The system of claim 6, wherein the delivery system comprises a pusher translatable along each of the base portion, the first extension, and the second extension.

* * * * *